US010905219B2

(12) United States Patent
Park

(10) Patent No.: US 10,905,219 B2
(45) Date of Patent: Feb. 2, 2021

(54) SYSTEM FOR SELECTIVE FLOCK APPLICATION TO AN APPLICATOR

(71) Applicant: L'OREAL, Paris (FR)

(72) Inventor: Kyoo Jin Park, Leonia, NJ (US)

(73) Assignee: L'OREAL, Paris (FR)

( * ) Notice: Subject to any disclaimer, the term of this patent is extended or adjusted under 35 U.S.C. 154(b) by 99 days.

(21) Appl. No.: 16/159,321

(22) Filed: Oct. 12, 2018

(65) Prior Publication Data

US 2020/0113308 A1 Apr. 16, 2020

(51) Int. Cl.

| | |
|---|---|
| ***A46B 3/00*** | (2006.01) |
| ***A46B 7/04*** | (2006.01) |
| ***A45D 34/04*** | (2006.01) |
| ***A45D 40/26*** | (2006.01) |

(52) U.S. Cl.

CPC ..... *A45D 40/262* (2013.01); *A45D 34/042* (2013.01); *A46B 3/00* (2013.01); *A46B 7/044* (2013.01); *A46B 2200/106* (2013.01)

(58) Field of Classification Search

CPC .. A45D 34/043; A45D 34/042; A45D 34/045; A45D 34/046; A45D 34/04; A45D 40/262; A45D 40/264; A45D 40/265; A45D 40/267; A45D 40/26; A46B 2200/106; A46B 3/00; A46B 3/22; A46B 7/00; A46B 7/04; A46B 7/044

See application file for complete search history.

(56) References Cited

U.S. PATENT DOCUMENTS

| | | | | |
|---|---|---|---|---|
| 4,467,822 | A * | 8/1984 | Blackwell | A46B 5/0033 132/311 |
| 6,053,179 | A * | 4/2000 | Lhuisset | A45D 40/262 132/142 |
| 9,516,939 | B2 * | 12/2016 | Pires | A46B 9/021 |
| 2014/0246043 | A1 | 9/2014 | Befve et al. | |

FOREIGN PATENT DOCUMENTS

| | | | |
|---|---|---|---|
| EP | 1 475 013 | B1 | 7/2006 |
| EP | 2 332 443 | B1 | 7/2013 |
| JP | 2007-50183 | A | 3/2007 |
| JP | 2014-83105 | A | 5/2014 |
| KR | 10-2010-0038955 | A | 4/2010 |
| WO | WO 2008/091128 | A1 | 7/2008 |

* cited by examiner

*Primary Examiner* — David J Walczak

(74) *Attorney, Agent, or Firm* — Oblon, McClelland, Maier & Neustadt, L.L.P.

(57) ABSTRACT

A system for applying an adhesive includes: a shaft including a length and a diameter configured to be exposed to the adhesive coating; and a plurality of bristles connected to the shaft and configured not to be exposed to the adhesive coating when the shaft is exposed to the adhesive, wherein the shaft is at least partially hollow and includes a channel and at least one flow hole; the channel extends along the length direction of the shaft and at least partially into the shaft; an opening of the channel is disposed at a first end of the shaft and configured to receive a solution; the at least one flow hole is disposed on the surface of the shaft substantially opposite of the plurality of bristles; and the at least one flow hole is connected to the channel and configured to allow egress of the solution received through the channel.

6 Claims, 7 Drawing Sheets

SYSTEM FOR SELECTIVE FLOCK APPLICATION TO AN APPLICATOR

BACKGROUND

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly or impliedly admitted as prior art against the present invention.

The application of a flocking material to a surface may be used for myriad applications including art and decoration, home goods, cosmetics, etc. In general, a surface is flocked via first depositing a layer of adhesive, for example via dipping, rolling, spraying, doctor blading, screen printing, etc., followed by impregnating said layer of adhesive with flock fibers. The flock fibers may be almost entirely submerged in the adhesive, or partially inserted. For example, the flock fibers may be partially inserted into the adhesive and the resulting effect of said flocking may be a brush-like surface. A flocked applicator, such as one with a brush-like flocking, may be used for brushing or combing through filamentous objects, including but not limited to human hair. The preparation and application of flocking to an object's surface may become more challenging when the object includes structures that the flocking may be applied adjacent to, wherein it is desired that said structures remain substantially free of flocking. Accordingly, better methods and systems for selectively applying adhesive to an object are desired.

SUMMARY

The present disclosure relates to a system for applying an adhesive coating, including: a shaft including a length and a diameter configured to be exposed to the adhesive coating; and a plurality of bristles connected to the shaft and configured not to be exposed to the adhesive coating when the shaft is exposed to the adhesive, wherein the shaft is at least partially hollow and includes a channel and at least one flow hole; the channel extends along the length direction of the shaft and at least partially into the shaft; an opening of the channel is disposed at a first end of the shaft and configured to receive a solution; the at least one flow hole is disposed on the surface of the shaft substantially opposite of the plurality of bristles; and the at least one flow hole is connected to the channel and configured to allow egress of the solution received through the channel.

In one embodiment, the system additionally includes: a spine including a pin attached to the spine at a first end of the spine, wherein the shaft includes a tip orifice at a second end of the shaft configured to receive the pin of the spine; the plurality of bristles are mounted on the spine; and the plurality of bristles are connected to the shaft via inserting the pin of the spine into the tip orifice of the shaft and the spine comes to rest along the surface of the shaft after the shaft is exposed to the adhesive coating.

In one embodiment, the system additionally includes: a cover and a hinge, wherein the cover is attached to the hinge; the hinge is attached to the shaft at a second end of the shaft; and the hinge is configured to rotate the attached cover over the plurality of bristles.

The present disclosure additionally relates to a method of selectively applying an adhesive coating, comprising coating a shaft with an adhesive, the shaft including a length and a diameter; preventing coating of a plurality of bristles connected to the shaft with the adhesive; and applying a flocking material to the adhesive selectively coated on the shaft, wherein the shaft is at least partially hollow and includes a channel and at least one flow hole; the channel extends along the length direction of the shaft and at least partially into the shaft; an opening of the channel is disposed at a first end of the shaft and configured to receive a solution; the at least one flow hole is disposed on the surface of the shaft substantially opposite of the plurality of bristles; and the at least one flow hole is connected to the channel and configured to allow egress of the solution received through the channel.

In one embodiment, the preventing step further comprises removing the plurality of bristles connected to the shaft prior to coating the shaft with the adhesive, the plurality of bristles being connected to the shaft via a spine inserted in a tip orifice at a second end of the shaft, the plurality of bristles being mounted on the spine, the spine including a pin attached at a first end of the spine, the tip orifice being configured to receive the pin of the spine.

In one embodiment, the preventing step further comprises covering the plurality of bristles with a cover prior to coating the shaft with the adhesive, the cover being attached to the shaft at a second end of the shaft via a hinge, the hinge being configured to rotate the attached cover over the plurality of bristles.

The foregoing paragraphs have been provided by way of general introduction, and are not intended to limit the scope of the following claims. The described aspects, together with further advantages, will be best understood by reference to the following detailed description taken in conjunction with the accompanying drawings.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1A:
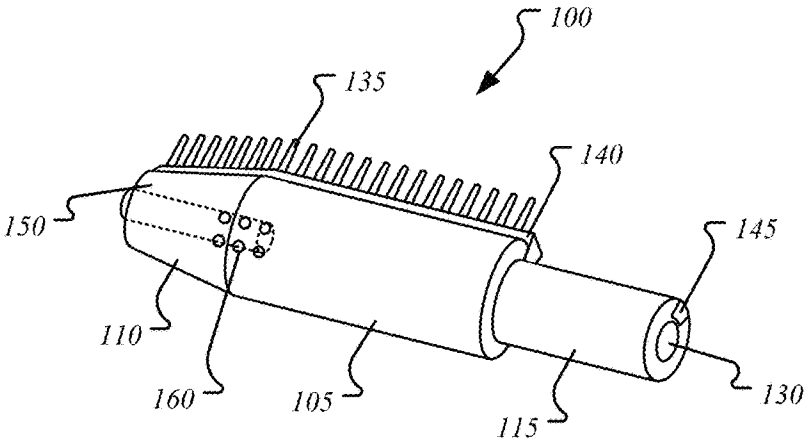
FIG. 1A is a perspective view schematic of an applicator, according to an exemplary aspect of the present disclosure.

The description set forth below in connection with the appended drawings is intended as a description of various aspects of the disclosed subject matter and is not necessarily intended to represent the only aspect(s). In certain instances, the description includes specific details for the purpose of providing an understanding of the disclosed subject matter. However, it will be apparent to those skilled in the art that aspects may be practiced without these specific details. In some instances, well-known structures and components may be shown in block diagram form in order to avoid obscuring the concepts of the disclosed subject matter.

Reference throughout the specification to "one aspect" or "an aspect" means that a particular feature, structure, characteristic, operation, or function described in connection with an aspect is included in at least one aspect of the disclosed subject matter. Thus, any appearance of the phrases "in one aspect" or "in an aspect" in the specification is not necessarily referring to the same aspect. Further, the particular features, structures, characteristics, operations, or functions may be combined in any suitable manner in one or more aspects. Further, it is intended that aspects of the disclosed subject matter can and do cover modifications and variations of the described aspects.

It must be noted that, as used in the specification and the appended claims, the singular forms "a," "an," and "the" include plural referents unless the context clearly dictates otherwise. That is, unless clearly specified otherwise, as used herein the words "a" and "an" and the like carry the meaning of "one or more." Additionally, it is to be understood that terms such as "upper," "lower," "front," "rear," "side," "interior," "exterior," and the like that may be used herein, merely describe points of reference and do not necessarily limit aspects of the disclosed subject matter to any particular orientation or configuration. Furthermore, terms such as "first," "second," "third," etc., merely identify one of a number of portions, components, points of reference, operations and/or functions as described herein, and likewise do not necessarily limit aspects of the disclosed subject matter to any particular configuration or orientation.

Flocking of an applicator may be achieved via application of an adhesive coating with sufficient thickness such that flock fibers not only anchor to the surface of said adhesive coating, but also penetrate into said adhesive coating to a predetermined depth. Said penetration depth, along with various other factors including, but not limited to, flocking fiber stiffness, adhesive stiffness, etc. may result in myriad types of flocking for different applications. A brush-like flocked applicator may be produced for cosmetics. The flocked applicators may utilize an added liquid or resin to more efficiently spread said liquid or resin throughout a user's hair. In a non-limiting example, the flocked applicator may be used to apply mascara to eyelashes. In another non-limiting example, the flocked applicator may be used to apply clear or pigmented eyebrow gel to eyebrows. Application of said liquid or resin may also result in clumping of hair. A more rigid comb structure may be utilized to separate the clumped hair. The comb may be integrated into the flocked applicator, wherein the manufacture of said integrated device may include a design and method to prevent application of adhesive to said comb structure.

FIG. 1A illustrates a perspective view of an applicator 100, according to an exemplary aspect of the present disclosure. The applicator 100 may include a shaft 105 disposed between a tip 110 and a connector 115. The shaft 105 may have a predetermined length, diameter, and cross-sectional shape based on a predetermined amount of flocking desired for a particular application. For example, a circular cross-section may be used (as shown). The tip 110 may be attached to the shaft 105 at a first end of the applicator 100 and designed to be the same diameter as the shaft 105, rounded, pointed, tapered (as shown), or any combination thereof. The connector 115 may be attached to the shaft 105 on a second end of the applicator 100. The connector 115 may be designed to have the same diameter, a larger diameter, or a smaller diameter (as shown) than the shaft 105. The connector 115 may have a predetermined length and cross-sectional shape, and be configured to attach to another part. In a non-limiting example, the connector 115 has a smaller diameter than the shaft and mates with a complementary part, such as an applicator grip (not shown) having a diameter the same as the shaft, wherein the applicator grip has an inner diameter that is approximately the same as the outer diameter of the connector 115, wherein the connector 115 inserts into said inner diameter of said applicator grip. In another non-limiting example, the connector 115 has the same outer diameter as the shaft 105 and the predetermined inner diameter of the connector 115 is configured to receive the outer diameter of the applicator grip.

The applicator may include a plurality of bristles 135 (herein referred to as bristles 135) oriented in at least one row and configured to separate hairs. The at least one row of bristles 135 may be substantially straight (as shown), curved, zig-zag, etc. The bristles 135 may be oriented in one row (as shown), or multiple rows, for example 2 rows, 3 rows, or greater than 3 rows.

In one aspect, the applicator 100 may include a channel 130 at the second end configured to receive a solution. For example, the solution could be mascara, eyebrow gel, etc. that is squeezed, pumped, extracted, etc. from a reservoir attached to the connector 115. The channel 130 may extend through the connector 115 into a portion of the shaft 105 and exit via at least one flow hole 160 along the shaft 105. The excreted solution may be applied to, for example, eyelashes, eyebrows, etc.

The surface of the shaft 105 and the tip 110 may be configured to receive an application of an adhesive and an application of a flocking material. In one aspect, the bristles 135 are first removed to prevent flocking of the bristles 135.

Figure 1B:
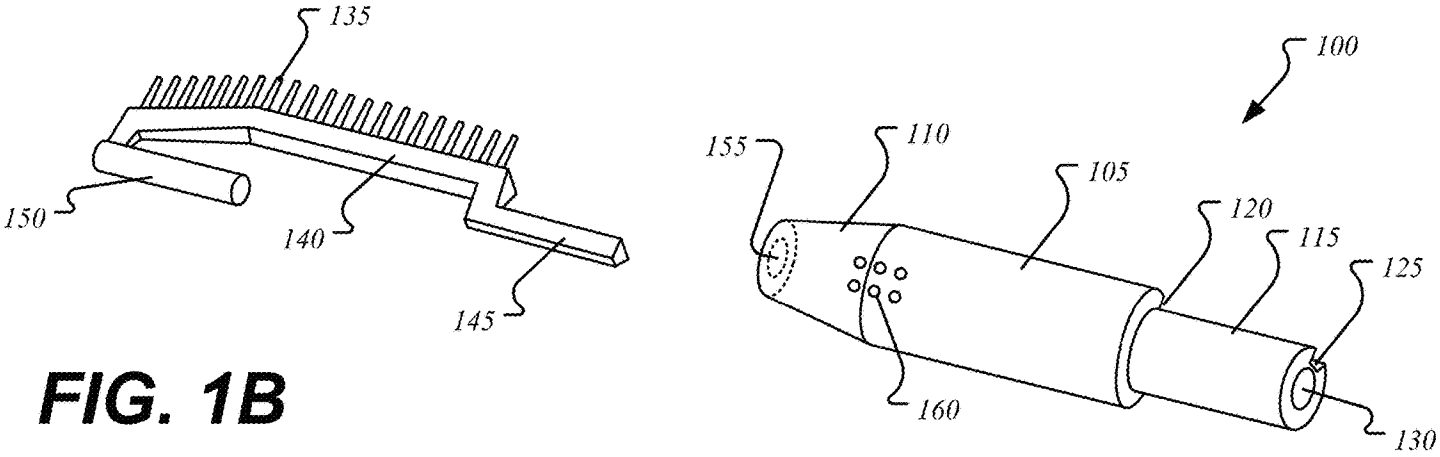
FIG. 1B is a perspective view schematic of an applicator with a plurality of bristles removed, according to an exemplary aspect of the present disclosure.

FIG. 1B illustrates a perspective view of an applicator 100 with the bristles 135 removed, according to an exemplary aspect of the present disclosure. The bristles 135 may be mounted on a spine 140. The shape of the spine may determine the shape of the at least one row of bristles 135. For example, the spine 140 may be substantially straight (as shown), curved, zig-zag, etc. The spine 140 may be designed to contour to the outer shape of the tip 110 and shaft 105. For example, the spine 140 may have an angle at a first end of the spine 140 to follow the contour of the tapered tip 110. In another aspect, at a second end of the spine 140, the spine 140 may bend to follow the contour of the transition step from the outer diameter of the shaft 105 to the outer diameter of the connector 115. The bend in the spine 140 may form a handle 145, wherein the handle 145 follows the shape of the connector 115.

The spine 140 may be sized such that the bristles 135 are elevated above the surface of the shaft 105 and tip 110 (as shown in FIG. 1A). At the second end where the spine 140 aligns with the connector 115, the handle 145 may be sized to be flush with the outer surface of the connector 115 (as shown in FIG. 1A) such that the connector 115 with the inserted spine 140 may both be mated to the complementary part (e.g. the applicator grip) having a predetermined contiguous inner diameter. In another aspect, the handle 145 may be elevated above the surface of the connector 115 and provide a reference feature which may be used to align the complementary part (e.g. the applicator grip) having a predetermined non-contiguous inner diameter with matching aligning feature.

The spine 140 may include a pin 150 attached at the first end of the spine 140. The pin 150 may be inserted into and aligned to the tip 110 via a tip orifice 155, wherein the tip orifice 155 is disposed at the first end of the applicator 100 on the tip 110. The cross-sectional shape of both the pin 150 and tip orifice 155 may be circular (as shown) or shaped such that the pin 150 and tip orifice 155 have complementary shapes. For example, the cross sectional shape of both may be square and the pin 150 may be inserted such that the square cross-section of the pin 150 aligns with the square cross-section of the tip orifice 155. The tip orifice 155 may have a diameter equal to or larger than the diameter of the pin 150.

In one aspect, when inserted, the handle 145 may slide along a first notch 120 and come to rest in a second notch 125, and the spine 140 may come to rest in the first notch 120. The first notch 120 may be a groove or segment of material removed from the shaft 105 and the tip 110, and the second notch may be a groove or segment of material removed from the connector 115, wherein the segments of removed material may have cross-sectional shapes substantially similar to the cross-sectional shapes of the spine 140 and handle 145 and allow said spine 140 and handle 145 to sit inside.

In one aspect, in inserting the pin 150, the spine 140 may deform slightly as it slides along the outer surface of the tip 110 and shaft 105. Upon full insertion, the bend in the spine 140 slides over the transition from shaft 105 to connector 115 and the handle 145 comes to rest in the second notch, allowing the spine 140 to no longer deform. In this configuration, the bend in the spine 140 also acts as a locking mechanism by abutting material along the transition from shaft 105 to connector 115.

In another aspect, the first notch 120 may be non-uniform along the shaft 105, wherein more shaft 105 material is removed towards the second end of the applicator 100 such that the deepest groove of the first notch 120 is substantially aligned with the deepest groove of the second notch 125. The spine 140 may be inserted into the first notch 120 in a direction substantially perpendicular to a length of the applicator 100 running form the first end to the second end of the applicator 100 such that the handle 145 is inserted into the deeper portion of the first notch 120 towards the second end of the applicator 100. Once the spine 140 is inserted and the pin 150 is aligned with the tip orifice 155, the spine may be slid towards the second end of the applicator 100 to insert the pin 150 into the tip orifice 155.

In one aspect, the applicator 100 with the spine 140 and bristles 135 removed is dipped into a reservoir containing a solution of adhesive to coat the surface of the shaft 105 and the tip 110. For example, the applicator 100 may be dipped wherein the tip 110 is inserted into the adhesive solution first, followed by the shaft 105, and the connector 115 is not coated with adhesive. In this manner, the channel 130 may remain free of adhesive.

In one aspect, the surface of the reservoir is parallel to the ground and the applicator 100 is dipped in a direction such that the length of the applicator 100 is orthogonal to the surface of the reservoir and the applicator 100 is dipped with the tip 110 first, wherein the solution of adhesive is substantially prevented from entering the tip orifice 155 via an air pocket created and the resulting air pressure of said air pocket.

After the application of the adhesive, the applicator 100 dipped in adhesive may receive the spine 140 and the flocking material may be applied to the surface of the shaft 105 and tip 110 that are coated in adhesive. Non-limiting examples of application methods include at least one of electrostatic, gravity, spraying, and transfer, or any combination thereof. Non-limiting examples of flocking material include at least one of cotton, rayon, polyamides (Nylon), and polyester, or any combination thereof.

Figure 2A:
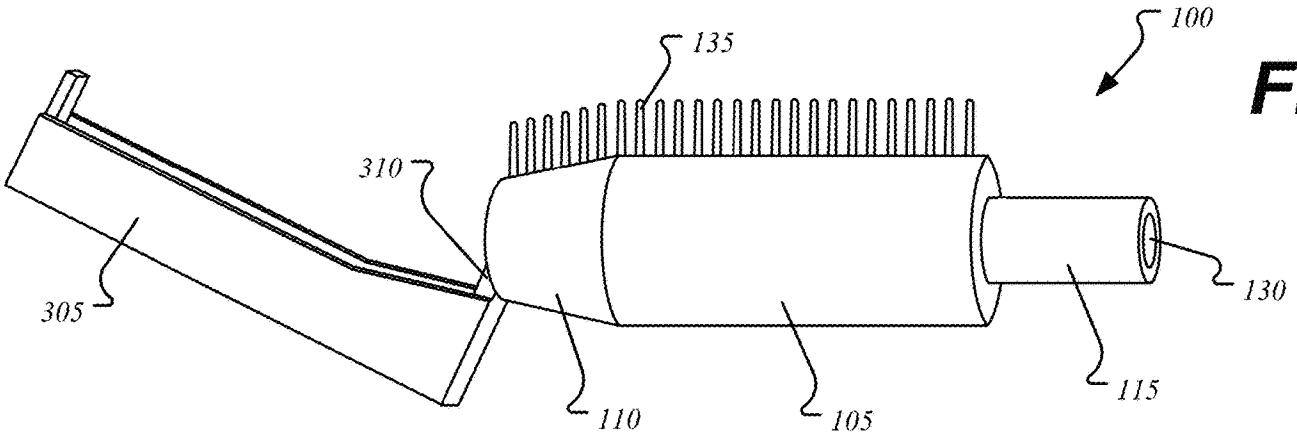
FIG. 2A is a perspective view schematic of an applicator with a cover, according to an exemplary aspect of the present disclosure.

FIG. 2A illustrates a perspective view of the applicator 100 including a cover 305, according to an exemplary aspect of the present disclosure. In one aspect, the bristles 135 are protected from the application of adhesive via the cover 305. The cover 305 may be attached to the applicator 100 at the first end via a hinge 310. The hinge 310 may be configured to flip the cover 305 on to and off of the bristles 135. The cover 305 may have a volume sufficient enough to enclose the bristles 135. The shape of the cover 305 may be substantially rectangular (as shown), rectangular with a rounded top, or triangular. The edges of the cover 305 in contact with the tip 110 and shaft 105 may be shaped to follow the contour of the tip 110 and shaft 105 outer surface.

Figure 2B:
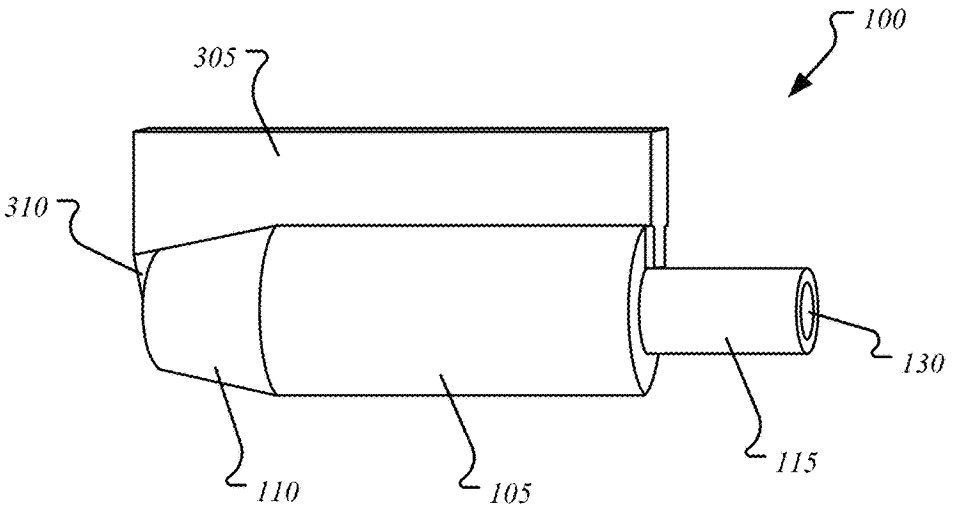
FIG. 2B is a perspective view schematic of an applicator with a cover closed over a plurality of bristles, according to an exemplary aspect of the present disclosure.

FIG. 2B illustrates a perspective view of the applicator 100 including a cover 305 closed over the bristles 135, according to an exemplary aspect of the present disclosure. In one aspect, the cover 305 may be closed over the top of the bristles 135. During adhesive application, for example when the applicator 100 is dipped into the solution of adhesive, the edges of the cover 305 in contact with the tip 110 and shaft 105 may form a temporary seal with said tip 110 and shaft 105 and prevent adhesive from entering into an inner volume of the cover 305 containing the bristles 135.

For example, the applicator 100 may be dipped with the tip 110 being submersed first up to the second end of the shaft 105 (where it transitions to the connector 115), and the bristles 135, connector 115, and channel 130 may remain free of adhesive. During the course of the adhesive application, the cover 305 and hinge 310 may be covered in the adhesive coating as well.

In one aspect, after application of the adhesive, the cover 305 and hinge 310 may be removed from the applicator 100. For example, the cover 305 and hinge 310 may be cut from the tip 110. In another example, the cover 305 and hinge 310 may be designed with a weak attachment to the tip 110 such that a user using their hands may pull the cover 305 and hinge 310 off the tip 110.

After application of the adhesive, flocking may proceed with the cover 305 and hinge 310 attached or detached.

Figure 3A:
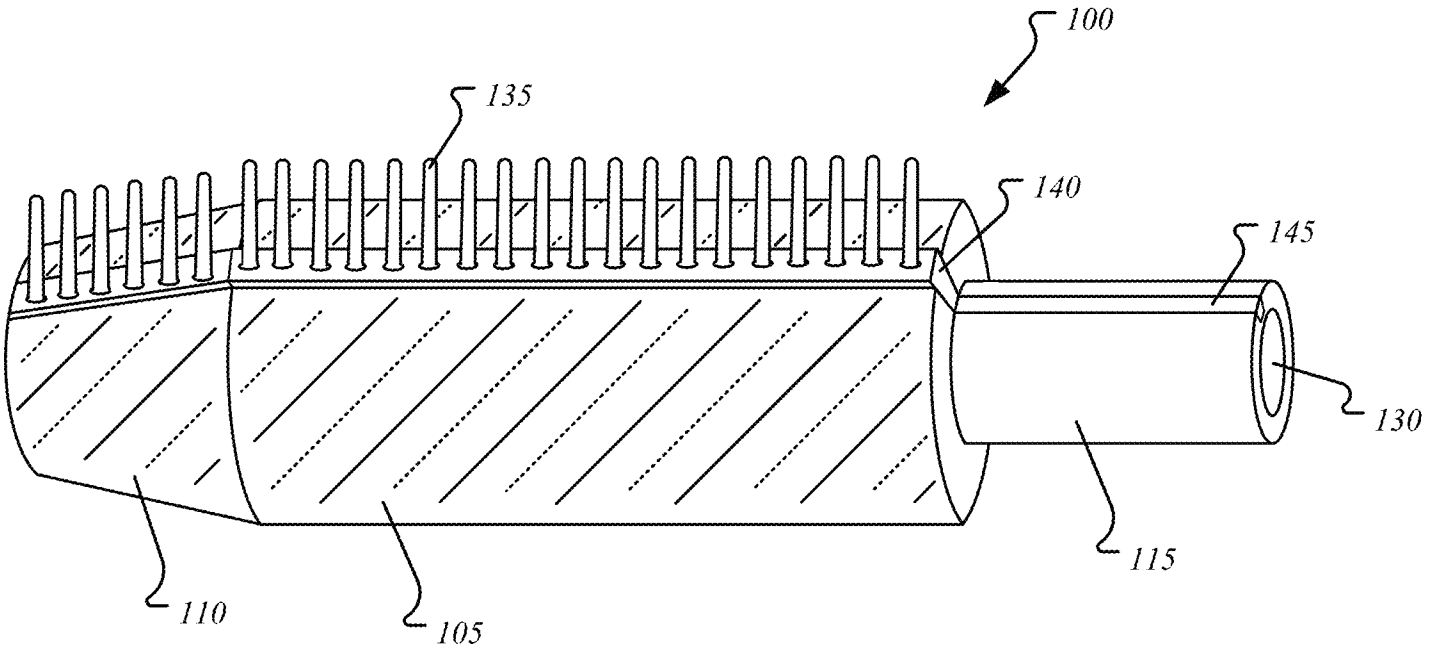
FIG. 3A is a perspective view schematic of an applicator with an inserted spine after application of an adhesive, according to an exemplary aspect of the present disclosure.

FIG. 3A illustrates a perspective view of the applicator 100 with the inserted spine 140 after application of adhesive, according to an exemplary aspect of the present disclosure. In one aspect, the surface of the tip 110 and shaft 105 are coated in adhesive (shaded area) while the bristles 135 mounted on the spine 140 are free of adhesive.

Figure 3B:
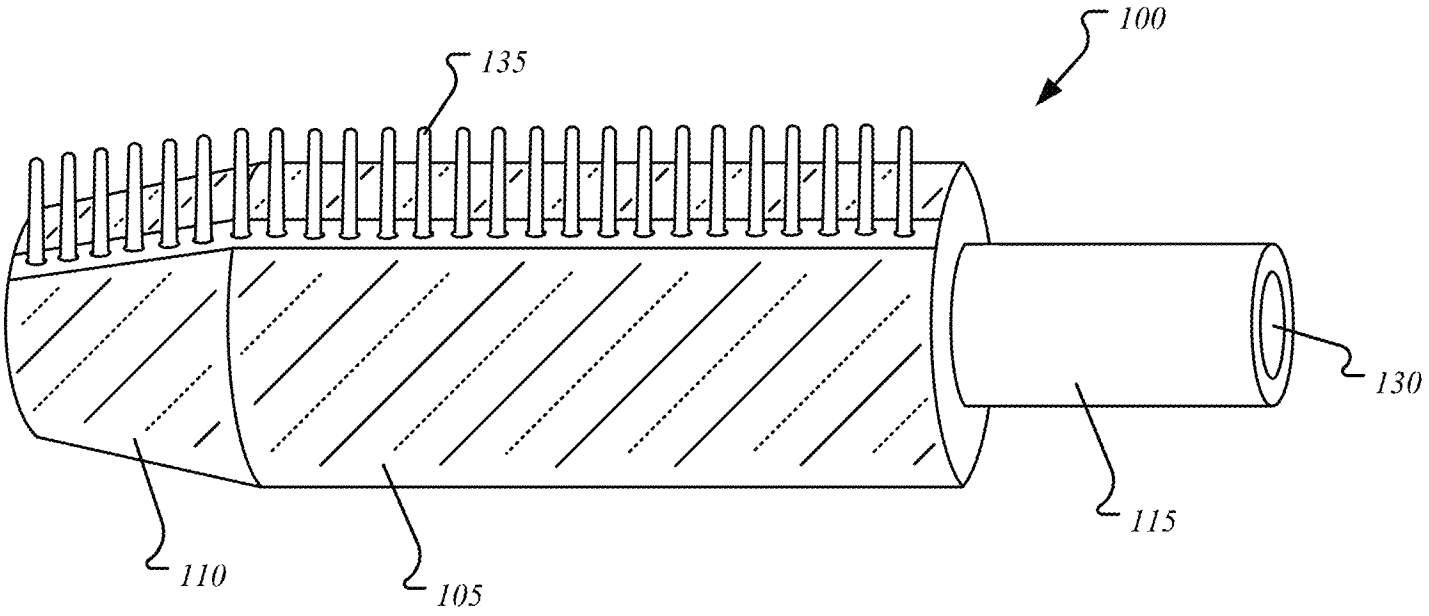
FIG. 3B is a perspective view schematic of an applicator with a cover removed after application of an adhesive, according to an exemplary aspect of the present disclosure.

FIG. 3B illustrates a perspective view of the applicator 100 with the cover 305 removed after application of adhesive, according to an exemplary aspect of the present disclosure. In one aspect, the surface of the tip 110 and shaft 105 are coated in adhesive (shaded area) while the bristles 135 were covered by the cover 305 during adhesive application and thus are free of adhesive after removal of the cover 305.

Figure 4:
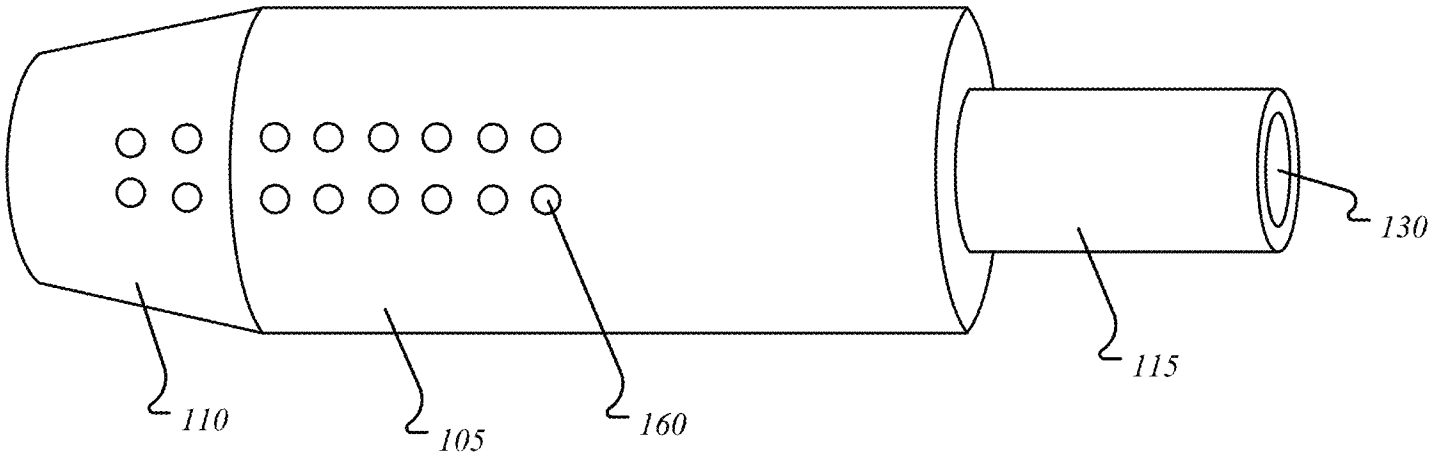
FIG. 4 is a perspective view schematic of an applicator with at least one flow hole, according to an exemplary aspect of the present disclosure.

FIG. 4 illustrates a perspective view of the applicator 100 with the at least one flow hole 160, according to an exemplary aspect of the present disclosure. In one aspect, the at least one flow holes 160 are disposed opposite the bristles 135. After application of the adhesive, the at least one flow holes 160 may be covered in adhesive. The at least one flow holes 160 may be cleared of adhesive via myriad techniques. In one non-limiting example, the at least one flow holes 160 may be punctured with a sharp object. In one non-limiting example, a gas may be injected into the channel 130 and the pressure from said gas may tear the adhesive coating over each of the at least one flow holes 160.

Figure 5:
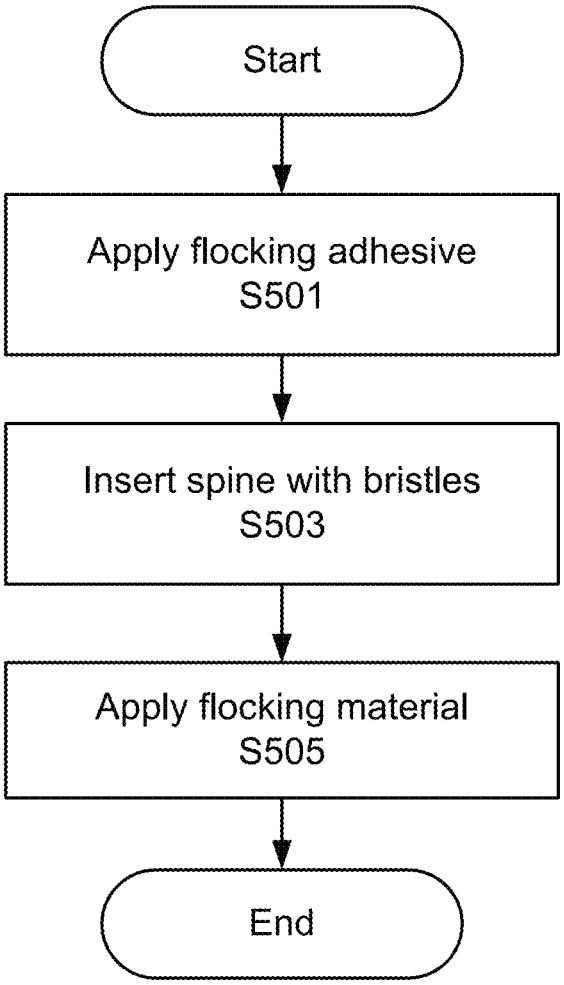
FIG. 5 is a flow chart for a method of applying an adhesive coating to an applicator, according to an exemplary aspect of the present disclosure.

FIG. 5 illustrates a flow chart for a method of applying the adhesive coating to the applicator 100, according to an exemplary aspect of the present disclosure. In step S501, the spine with the bristles 135 are not inserted in the applicator 100, and flocking adhesive may be applied to the tip 110 and shaft 105. In step S503, the spine 140 with the bristles 135 is inserted in the applicator 100. In step S505, the flocking material is applied and anchored to the adhesive coating covering the tip 110 and shaft 105.

Figure 6:
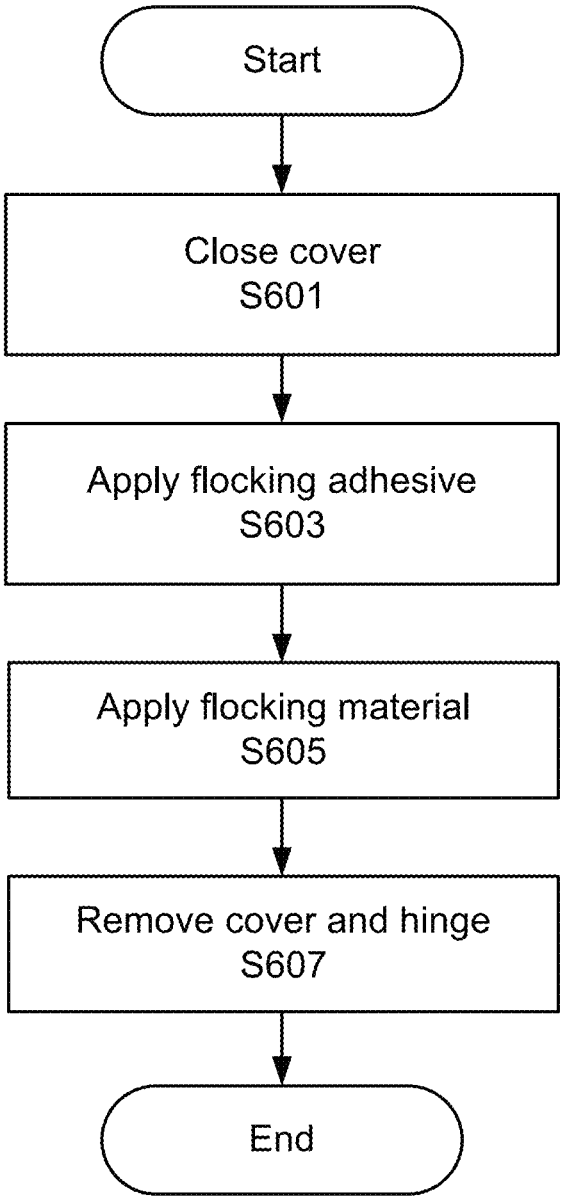
FIG. 6 is a flow chart for a method of applying an adhesive coating to an applicator with a cover, according to an exemplary aspect of the present disclosure.

FIG. 6 illustrates a flow chart for a method of applying the adhesive coating to the applicator 100 with the cover 305, according to an exemplary aspect of the present disclosure. In step S601, the cover 305 is closed over the bristles 135. In step S603, flocking adhesive may be applied to the tip 110 and shaft 105. Consequently, the cover 305 and hinge 310 may also be coated with the flocking adhesive. In step S605, the flocking material is applied and anchored to the adhesive coating covering the tip 110 and shaft 105. In step S607, the cover 305 and hinge 310 are detached from the tip 110 of the applicator 100.

A number of implementations have been described. Nevertheless, it will be understood that various modifications may be made without departing from the spirit and scope of this disclosure. For example, preferable results may be achieved if the steps of the disclosed techniques were performed in a different sequence, if components in the disclosed systems were combined in a different manner, or if the components were replaced or supplemented by other components.

The foregoing discussion describes merely exemplary embodiments of the present disclosure. As will be understood by those skilled in the art, the present disclosure may be embodied in other specific forms without departing from the spirit or essential characteristics thereof. Accordingly, the disclosure is intended to be illustrative, but not limiting of the scope of the disclosure, as well as the claims. The disclosure, including any readily discernible variants of the teachings herein, defines in part, the scope of the foregoing claim terminology such that no inventive subject matter is dedicated to the public.

The invention claimed is:

1. A system for applying an adhesive coating, comprising:

a spine including a pin attached to the spine at a first end of the spine and a locking bend disposed proximal to a second end of the spine;

a shaft including a first length, a first diameter, and a tip orifice at a first end of the shaft configured to receive the pin of the spine;

a connector including a second length and a second diameter, the connector being attached to the shaft at a second end of the shaft, the second diameter of the connector being smaller than the first diameter of the shaft; and a plurality of bristles mounted on the spine, the spine being connected to the shaft via inserting the pin of the spine into the tip orifice of the shaft and the spine comes to rest along a surface of the shaft and the connector, wherein the locking bend of the spine couples with the shaft and the connector at a transition where the shaft attaches to the connector, and the locking bend of the spine abuts a material of the shaft having the larger first diameter to prevent motion of the spine towards the first end of the shaft.

2. The system of claim 1, wherein the shaft is at least partially hollow and includes a channel and at least one flow hole;

the connector is hollow;

the channel extends along the length direction of the connector and the shaft and at least partially into the shaft;

an opening of the channel is disposed at a first the second end of the shaft and configured to receive a solution; and the at least one flow hole is connected to the channel and configured to allow egress of the solution received through the channel.

3. The system of claim 2, wherein the at least one flow hole is disposed on the surface of the shaft substantially opposite of the plurality of bristles.

4. The system of claim 1, wherein the shaft and the connector include a notch extending the length of the surface of the shaft and the connector; and the notch is configured to receive the spine when the spine comes to rest along the surface of the shaft and the connector.

5. The system of claim 1, further comprising:

a cover and a hinge, wherein the cover is attached to the hinge;

the hinge is attached to the shaft at a first end of the shaft; and the hinge is configured to rotate the attached cover over the plurality of bristles.

6. The system of claim 5, wherein the hinge is configured to rotate the attached cover over the plurality of bristles when the shaft is exposed to the adhesive;

a plurality of edges of the cover in contact with the shaft form a seal with the shaft; and the seal between the plurality of edges of the cover in contact with the shaft and the shaft prevent adhesive from entering an interior of the cover.

* * * * *